United States Patent [19]

Becker

[11] Patent Number: 4,927,501

[45] Date of Patent: May 22, 1990

[54] OVEN DOOR

[75] Inventor: Wolfgang Becker, Bochum, Fed. Rep. of Germany

[73] Assignee: Ruhrkohle AG, Essen, Fed. Rep. of Germany

[21] Appl. No.: 225,686

[22] Filed: Jul. 28, 1988

[30] Foreign Application Priority Data

Aug. 3, 1987 [DE] Fed. Rep. of Germany ..... 3725537
Dec. 19, 1987 [DE] Fed. Rep. of Germany ..... 3743156

[51] Int. Cl.[5] ..... C10B 25/06

[52] U.S. Cl. ..... 202/248; 202/268; 202/269

[58] Field of Search ..... 202/242, 245, 247, 248, 202/269, 268; 110/173 R; 126/190; 49/480, 485; 432/250

[56] References Cited

U.S. PATENT DOCUMENTS

| | | | |
|---|---|---|---|
| 2,993,845 | 7/1961 | Coe | 202/248 |
| 3,948,397 | 4/1976 | Ikio | 212/4 |
| 4,086,145 | 4/1978 | Muller | 202/248 |
| 4,126,520 | 11/1978 | Horster | 202/248 |
| 4,198,274 | 4/1980 | Ikio | 202/248 |
| 4,292,137 | 9/1981 | Fujita et al. | 202/248 |
| 4,381,972 | 5/1983 | Stog | 202/248 |
| 4,384,652 | 5/1983 | Gregor | 212/166 |
| 4,414,072 | 11/1983 | Breidenbach et al. | 202/248 |
| 4,647,343 | 3/1987 | Stog et al. | 202/248 |
| 4,683,032 | 7/1987 | Becker et al. | 202/248 |
| 4,713,148 | 12/1987 | Offermann | 202/248 |
| 4,740,271 | 4/1988 | Becker et al. | 202/248 |

FOREIGN PATENT DOCUMENTS

| | | | |
|---|---|---|---|
| 186934 | 7/1907 | Fed. Rep. of Germany . | |
| 732547 | 3/1943 | Fed. Rep. of Germany . | |
| 913764 | 6/1954 | Fed. Rep. of Germany . | |
| 3105726 | 3/1982 | Fed. Rep. of Germany . | |
| 3105703 | 6/1982 | Fed. Rep. of Germany . | |
| 3423816 | 1/1986 | Fed. Rep. of Germany | 202/248 |
| 3540845 | 5/1987 | Fed. Rep. of Germany | 202/248 |
| 3637615 | 5/1988 | Fed. Rep. of Germany | 202/248 |

*Primary Examiner*—Joye L. Woodard
*Attorney, Agent, or Firm*—Nils H. Ljungman

[57] ABSTRACT

A metal shield is for an oven which has an interior, a door opening which is surrounded by a door frame, and a door for extending across the door opening. The door is for making sealing contact with the door frame. The metal shield includes a plurality of generally parallel elongated metal members which combine to form an array of elongated metal members substantially lying within a plane. The array of elongated metal members is disposed within the interior of the oven inwardly of the door frame and inwardly of the door when the door is in sealing contact with the door frame. The array of elongated metal members extends generally transversely to the interior of the oven with the plane being generally parallel to the door frame.

17 Claims, 7 Drawing Sheets

OVEN DOOR

BACKGROUND OF THE INVENTION

1. Field of the Invention

This invention relates to a metal shield for an oven which shield is installed in the interior of the oven.

2. Description of the Prior Art

A number of prior art patents disclose oven door configurations which include metal or ceramic plugs installed at the interior side of the oven door. Such prior art patents include German Patent Nos. 732,547; 913,764; U.S. Pat. Nos. 2,993,845; and 4,198,274.

Additional prior art patents disclose door configurations for ovens which include internal shielding intended to primarily protect the door and shield it from radiant heat. Such patents include German Patent Nos. 186,934: DE 31 05 703 Al; DE 31 05 726 Al; U.S. Pat. Nos. 4,086,145; and 4,414,072.

Additional prior art patents disclose specific configurations for locking the oven door in a closed position to provide proper sealing and to prevent undesired heat loss. Such patents include U.S. Pat. Nos. 4,683,032 and 4,740,271.

U.S. Pat. Nos. 3,948,397; 4,126,520; 4,292,137; and 4,384,652 disclose oven door lifting mechanisms which are employed to install and extract oven doors from door openings.

While the various prior art patents mentioned hereinabove are characterized as being primarily directed to one major feature of a particular oven configuration, it should be kept in mind that other features of the configurations disclosed therein may be pertinent in other areas of the oven art. For example, while one patent may be primarily directed to the locking mechanism for an oven door, the same prior art patent may disclose additional information regarding the door structure or internal shielding. Accordingly, the prior art patents discussed hereinabove are incorporated by reference as if they were included in their entirety herein.

OBJECTS OF THE INVENTION

It is an object of the invention to provide a metal shield for an oven door which is relatively inexpensive and simple to manufacture.

It is another obJect of the invention to provide such a metal shield which is reliable and capable of protecting the oven door, the chamber door frame and the sealing produced therebetween throughout operation of the oven.

SUMMARY OF THE INVENTION

These and other objects of the invention are provided in a preferred embodiment including a metal shield for an oven. The oven has an interior, a door opening which is surrounded by a door frame, and a door for extending across the door opening. The door is for making sealing contact with the door frame. The metal shield includes a plurality of generally parallel elongated metal members which combine to form an array of elongated metal members substantially lying within a plane. The array of elongated metal members is disposed within the interior of the oven inwardly of the door frame and inwardly of the door when the door is in sealing contact with the door frame. The array of elongated metal members extends generally transversely to the interior of the oven with the plane being generally parallel to the door frame.

Another embodiment of the invention includes a horizontal oven door assembly, wherein the horizontal oven has an interior defined by a ceiling, a floor, two side walls and a door opening which is surrounded by a door frame. The door assembly includes a heat shield for being disposed within the interior of the horizontal oven inwardly of the door frame. The heat shield extends generally between the two side walls and between the ceiling and the floor to lie within a plane which extends transversely of the interior of the horizontal oven when the heat shield means is disposed therein. The heat shield includes a plurality of generally parallel elongated metal members which combine to form an array of elongated metal members lying within the plane.

BRIEF DESCRIPTION OF THE DRAWINGS

The drawings show various embodiments of the invention.

DESCRIPTION OF THE PREFERRED EMBODIMENTS

Figure 1A:
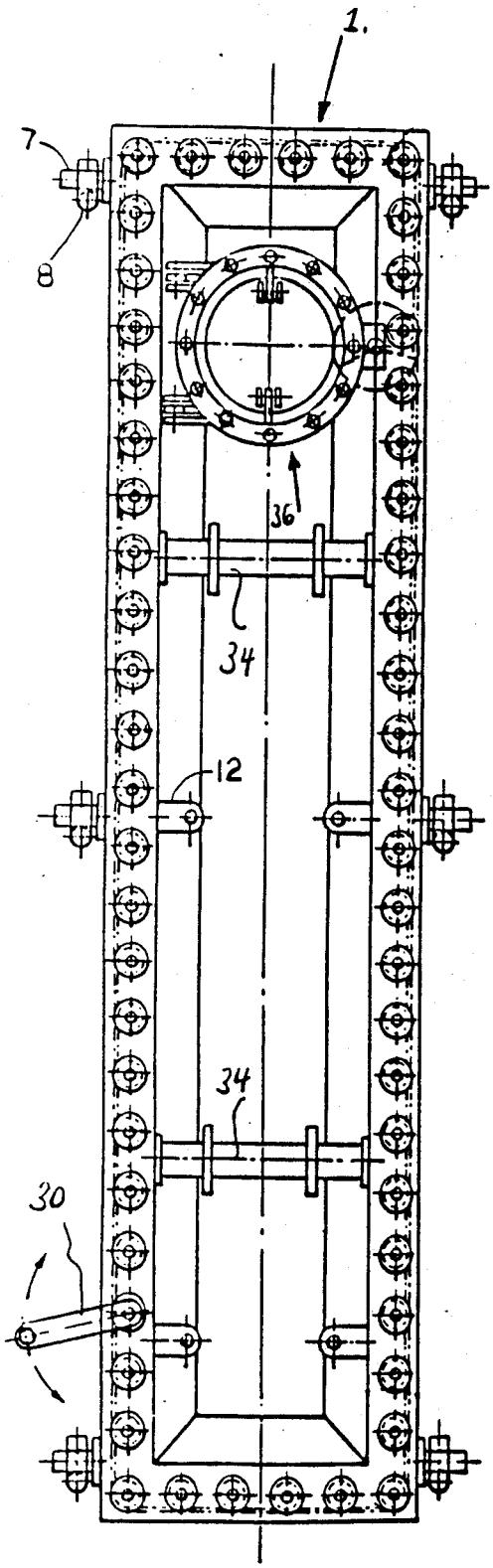
FIG. 1*a* shows an elevated front view of an oven door according to the invention in the closed position against the door frame.

Although suggestions have been made to use steel shields on oven doors as long ago as the turn of the century, such metal shields have never gained significant acceptance in actual practice. The reluctance to use such metal shields can, in part, be easily explained by the characteristics of the material available at that time. Steel shields which must come into direct contact with hot contents are exposed to temperatures significantly higher than 1000 degrees C. Steels with the necessary high-temperature strength, such as high-alloy steels, have only recently become available. The alloy ingredients might include various quantities of chromium, aluminum, nickel, silicon, and/or titanium. Approximately eight years ago, the first tests employing these improved steels were begun. These tests were based on the simulation of a ceramic plug by the use of plates of heat-resisting steel. Initially, however, the tests were not successful. Accordingly, the steel structure employed in oven door configurations has been primarily limited to use in one shield for the oven door. It is not uncommon for such a shield to include individual, overlapping plates However, it has been found that the plates also experience significant deformation. Therefore, various alternatives have been proposed with the objective being to create a practical partial shield with a long service life.

Numerous oven doors of the prior art have employed a massive cast iron body with a ceramic plug installed at the interior side thereof. Because of the ceramic plug, the oven charge was kept at a distance from the oven door. Recently, oven doors have been used which employ a shield structure instead of a massive, heavy ceramic plug. The shield structure has consisted primarily of metal, but some prior art doors also included ceramic shield structures.

Modern shield structures have, in common, tended to reduce the overall weight of the door bodies. The door bodies can accordingly be provided with an overall, lighter weight. A significant reduction in weight is achieved if, for the door bodies, a sealing element is used which produces sealing, contact pressure by means of a number of contact pressure elements of a force transmission unit. Such a force transmission unit would include a hollow profile frame which is disposed around the circumference of the door against the door frame of the oven.

Because of the modern design employing a shield structure, it is not uncommon to include a very large gas duct between the shield structure and the door body. The resulting large gas duct is generally regarded with skepticism. There have also been problems involving the fastening of such a shield structure to the door body. The use of some type of spacers is possible, but the spacers do not always provide an overall satisfactory solution.

In general, on conventional oven door bodies, two or more locking elements are distributed over the height of the door body and are rigidly connected thereto. Such locking elements consist of a doublearmed pivoting lever which corresponds to lock catches on the chamber door frame. Conventionally, all of the pivoting levers of the locking elements are connected to one another by means of rods and are rotated jointly by the door lifting device, whether locking or unlocking the door. Before locking, the oven door is moved by the door lifting device against the door frame in a manner to produce a desired door closing pressure. The locking elements are used to secure the door in this desired position.

With such an arrangement, it has been shown that, because of variations in the forces applied to the door body, consideration had to be given to the physical characteristics of the door body itself. The force was not applied evenly over the door body and was therefore not transmitted evenly to the sealing mechanism or the chamber door frame. As a result, door leakage was not uncommon. In the past, attempts have been made to seal or plug up the leaks with asbestos cords and, later, with ceramic cords. So-called hammered strips or adjustable sealing strips have also been used. Bolts or screws were used as the adjustment devices. Apart from the general objection to turning screws with blows from a hammer, it was also considered inappropriate to require the service personnel to climb up and down to remove leaks on oven doors which are four to eight meters high.

Figure 1B:
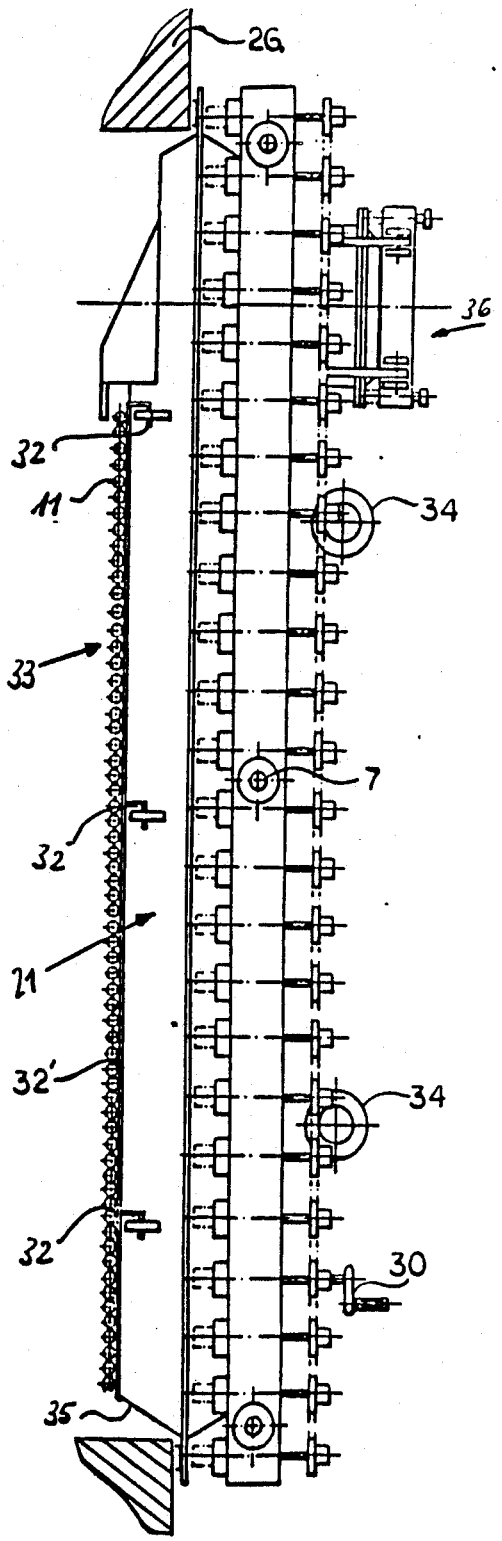
FIG. 1*b* is an elevational side view of the oven door of FIG. 1*a*.

As shown in FIGS. 1*a* and 1*b*, the coke oven door according to the invention comprises a locking device in the form of a force transmission unit 1 and a door closure element in the form of a sealing unit 21. The coke oven door is generally shown in the closed position against a chamber door frame 26 as it would be located during operation of the oven. The preferred oven is a horizontal coke oven which has an interior generally defined by a floor, a ceiling, two side walls and a vertical door opening. The height-to-width ratio of such a horizontal coke oven may be about four. As a result, there is an elongated, vertically extending door opening with a corresponding elongated, vertically extending door frame 26 and coke oven door.

Figure 2A:
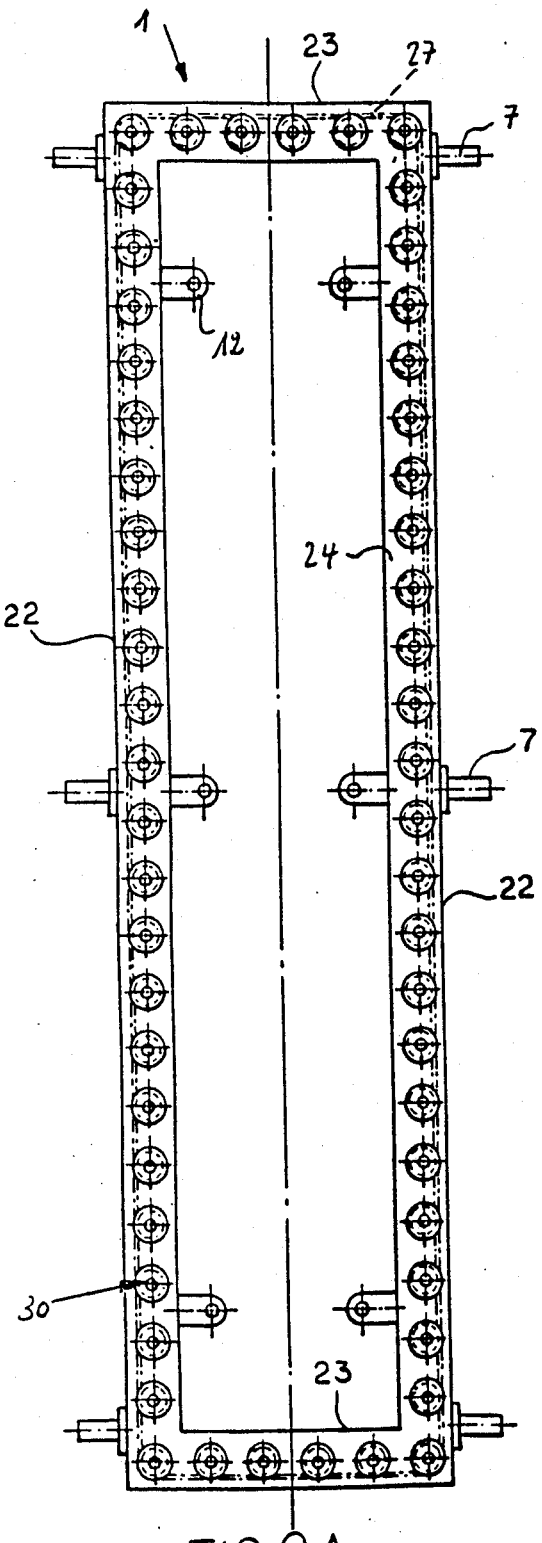
FIG. 2*a* shows an elevated front view of the hollow profile frame of the oven door of FIGS. 1*a* and 1*b* with the integrated automatically rotatable contact pressure elements including sprocket wheels and chains.
Figure 2B:
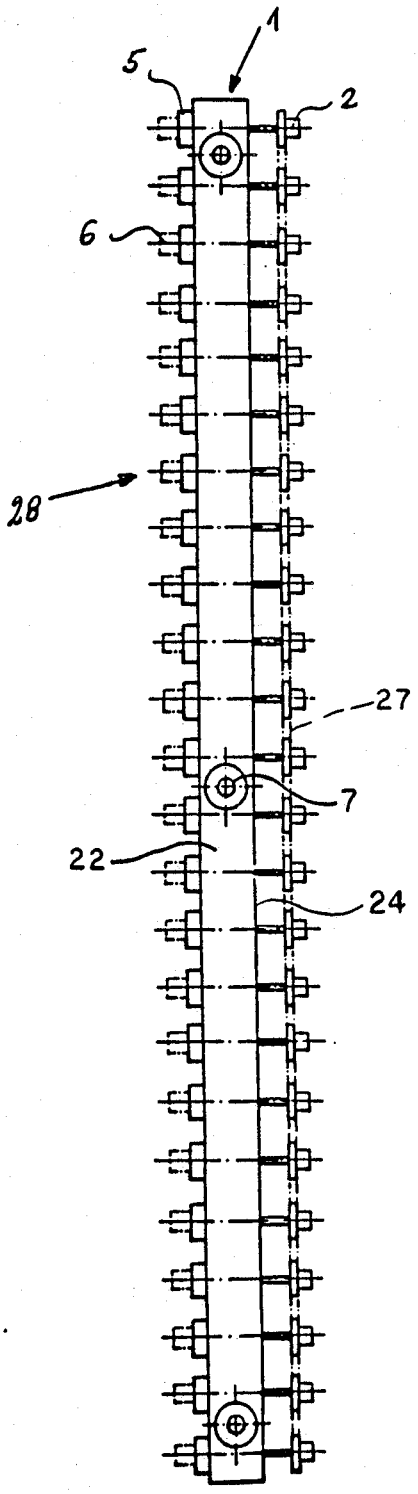
FIG. 2*b* is an elevational side view of the hollow profile frame of the oven door of FIG. 2*a*.
Figure 3:
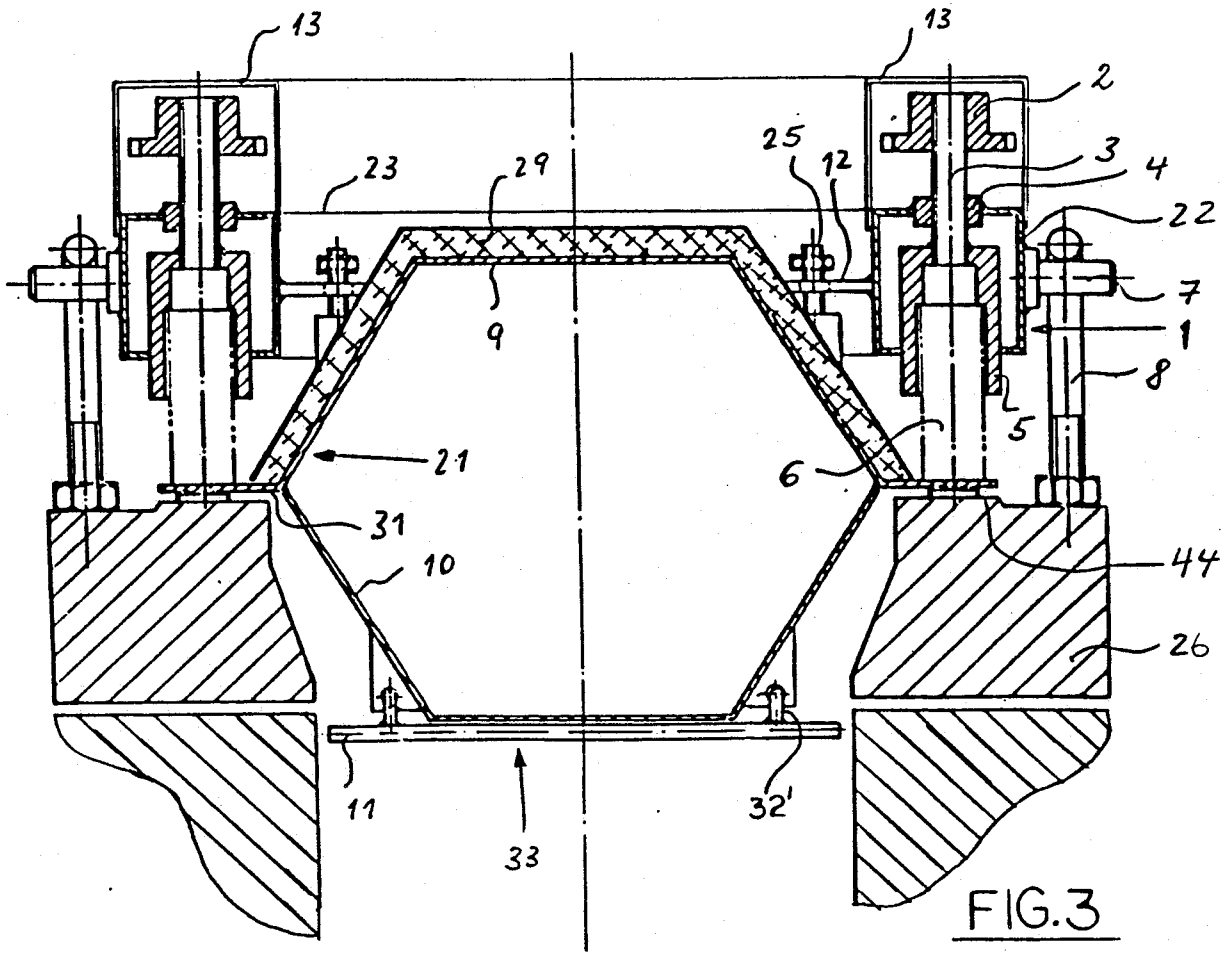
FIG. 3 shows an enlarged horizontal cross section of the oven door of FIGS. 1*a* and 1*b*.

As seen in FIGS. 2*a*, 2*b* and 3, the force transmission unit 1 includes a locking device support frame or hollow profile frame 24 having vertical, longitudinal beams 22 and horizontal, transverse beams 23. The longitudinal beams 22 are preferably open at the upper and lower ends thereof. Additionally, at the connection points to the transverse beams 23, there are also openings in the longitudinal beams 22, so that heated air in the hollow profile frame 24 can flow unobstructed out of the transverse beams 23 into the longitudinal beams 22 and then upwardly and out of the top of the hollow profile frame 24.

The hollow profile frame 24, as generally shown in FIGS. 2*a* and 2*b*, is provided with a number of contact pressure elements 28, which are themselves rotatable. Each of these contact pressure elements 28, as better seen in FIGS. 3 and 4, comprises a movable socket 5, a spindle 3 which is permanently connected to the socket 5, and a sprocket wheel 2 which is rigidly attached to the spindle 3. Each spindle 3 is rotatably mounted within a threaded socket 4. Each of the threaded sockets 4 is permanently welded into the hollow profile frame 24.

Figure 4:
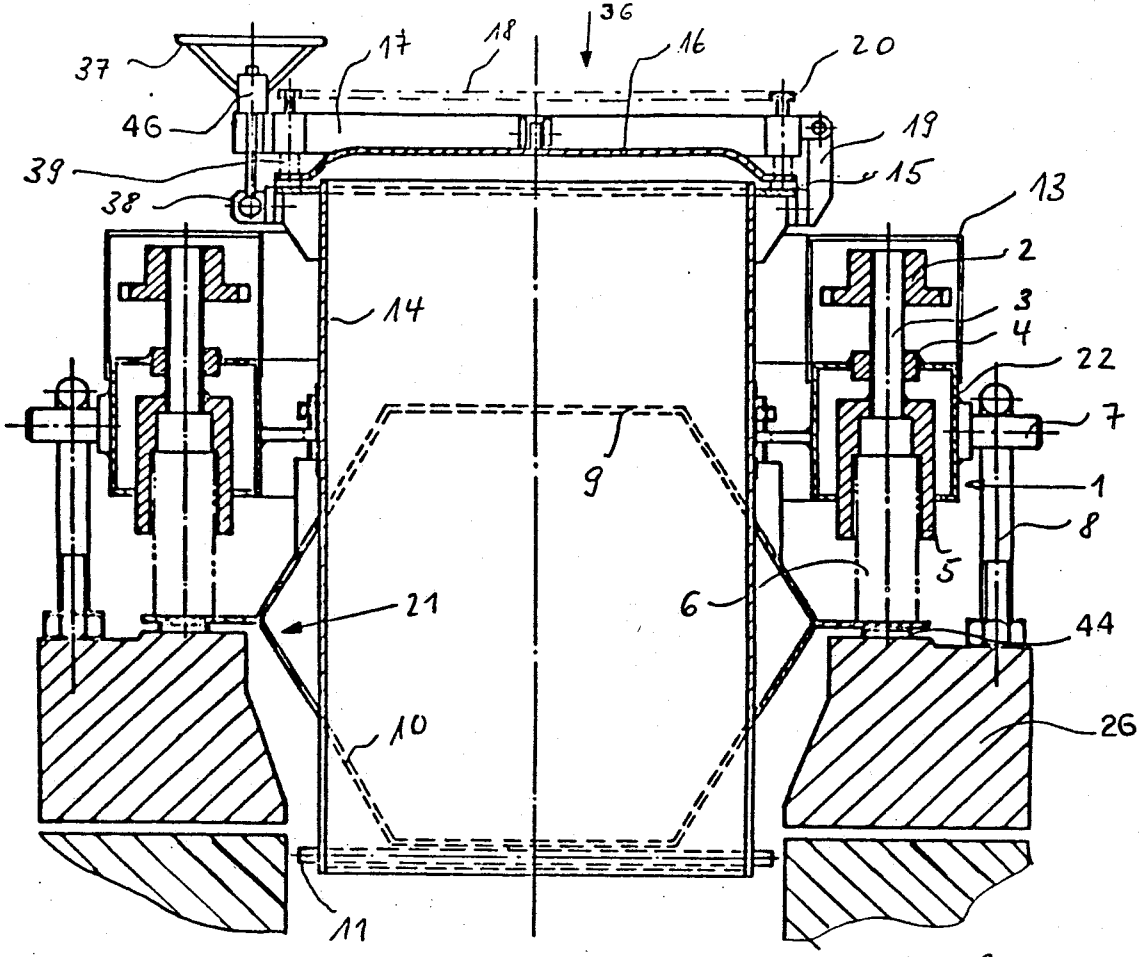
FIG. 4 shows an enlarged horizontal cross section of the oven door of FIGS. 1*a* and 1*b* along a section line in the vicinity of the leveller door including the leveller box.

The transmission of force from the contact pressure elements 28 to the sealing unit 21, as best seen in FIGS. 3 and 4, is accomplished by means of springs or bolts 6, which are located in the rotatable socket 5. The springs would tend to ensure adequate pressure is produced even if there are minor dimensional differences in the various contact pressure elements 28. Alternatively, bolts could be used if more positive means are preferred to produce the desired pressure and individual adJustment of each bolt is possible prior to installing and closing the door. With the springs or bolts 6 properly installed in each socket 5, the force is created by the axial movement of each of the rotatable sockets 5 as its respective spindle 3 is rotated within the threaded socket 4 by movement of a chain 27 which acts on each of the sprocket wheels 2. To protect the contact pressure elements 28 from heat, moisture and dust, a hood cover 13 is installed over the sprocket wheels 2 and the chain 27.

To achieve a positive anchor means or connection, on the one hand, between the chamber door frame 26 and the sealing unit 21 and, on the other hand, between the chamber door frame 26 and the force transmission unit 1, a number of bolts 7 are welded onto the external sides of the longitudinal beam 22, and adjustable catches 8 to hold the bolts 7 are attached to the chamber door frame 26. The number of catches 8 corresponds to the number of bolts 7, and, in the preferred embodiment, there are six of each. Basically, the number of bolts 7 employed is a function of the height of the oven. For an oven height of only four meters, a total of four bolts would suffice, with two at top and two at the bottom of the hollow profile frame 24 as generally shown in FIGS. 2*a* and 2*b*.

The contact pressure forces of the individual contact pressure elements 28 on the sealing unit 21 are produced by the encircling chain 27 as best seen in FIG. 2*a*. With this arrangement, an even distribution of forces is guaranteed by the force transmission unit 1 to the sealing unit 21. The turning point 30, as best seen in FIG. 2*a*, to move the encircling chain 27 can be alternatively located on any of the contact pressure elements 28. The torque required for the turning point 30 is produced by a torque motor (not shown). This torque motor can be installed either directly on the force transmission unit 1 or on the door operating machine.

Although the preferred hollow profile frame 24 has a generally square profile or cross section, other profiles or cross sections could alternatively be employed. The geometries of other commercially available profiles, such as rectangular hollow profiles, U-profiles, L-profiles, double-T profiles, tubular profiles and simple flat profiles, would also be capable of properly supporting the contact pressure elements 28.

As best seen in FIGS. 1*a*, 1*b* and 3, the sealing unit 21 includes an outer plate element 9 and insulation 29 thereon. The outer plate element 9 is combined with an inner plate element 10 to form a hollow body. Both plate elements 9 and 10 are made from a heat-resistant metal material. Depending on the profile required, each plate element of the sealing unit 21 is between two and four millimeters thick. The specific structural height and width of the oven have no significant effect on the thickness required, since the return forces exerted by the oven charge in conventional sized oven do not vary significantly from one another.

As seen in FIG. 3, the preferred plate elements 9 and 10 have the same generally U-shaped profile and are permanently connected to one another. However, it is also possible to provide the sealing unit 21 with some form of loose connection between plate element 9 and plate element 10.

The hollow body formed by plate elements 9 and 10 can be designed to be closed or, alternatively, to include openings in the plate element 10 toward the inside of the hollow body. In the latter embodiment, the plate element 10 is provided with lateral slots or is open in the vertical direction at the top and at the bottom. Whether the hollow body is closed or includes openings in the plate element 10, the basic embodiment includes two side gas ducts which are defined by a heat shield 33, the lateral surfaces of plate element 10 and the interior portion of the chamber door frame 26. The use of openings or slots in the plate element 10 expands the two side gas ducts to include an additional interior gas duct formed by and located within the hollow body of the sealing unit 21. When compared to conventional door designs which employ a shield structure instead of brick or ceramic plugs, the cross section or profile of the gas duct area can be increased by up to 100% by the use of such a hollow body with openings or slots. This enlargement of the gas duct area has a very positive effect on the static pressure behavior in the duct and also on the door seal.

As seen in FIG. 1*b*, the preferred sealing unit 21 according to the invention does not include a conventional door foot Because of its design, the inner plate element 10 assumes the function of a door foot 35.

As best seen in FIG. 3, between the exposed, peripheral edges 31 of the sealing unit 21 and the sealing surface of the chamber door frame 28, there is provided a metal U-shaped seal 44 in one preferred embodiment of the invention.

When the coke oven door is not installed in the opening of the oven, the sealing unit 21 is held loosely in position relative to the force transmission unit 1 by mountings 12 and 25 of the force transmission unit 1. When the door is inserted, the mountings 12 and 25 are no longer effective in order to accommodate for the different expansion characteristics caused by the different temperature positions of the sealing unit 21 and the force transmission unit 1.

To insert and extract the door by means of a door lifting machine (not shown), there are provided two transverse lifting bars 34 which extend between the longitudinal beams 22. The transverse lifting bars 34 serve as engagement points for the claws on the door lifting machine.

As seen in FIGS. 1*a*, 1*b* and 3, the preferred heat shield 33, according to the invention, no longer consists of flat, one-piece, heat-resistant metal plates with different structural shapes as shown in the prior art. Instead, the preferred heat shield 33 includes a number of elongated metal members, such as round, heat-resistant metal bars 11 which have the same cross section and extend in a direction transverse to the oven chamber at the interior side of the inner plate element 10. As best seen in FIG. 1*b*, the preferred bars 11 are loosely fastened to the inner plate element 10 at support points 32. The inner plate element 10 includes a central portion disposed within the interior of the oven inwardly of the door frame 26. The central portion generally supports most of the elongated metal members or bars 11 at at least the central region thereof The individual round bars 11 are between twenty and thirty millimeters thick and include holes drilled therethrough for suspension at two points. Vertically extending rod elements 32′ located near the end of each bar 11 include hooks for mounting at each support point 32. In one mounting configuration, each rod element 32′ includes a plurality of outwardly extending pins (not shown). Each pin is installed within a hole drilled through the bar 11 near the end thereof. To retain the bars 11 on the pins of the rod elements 32′, the end of each pin may, for example, be provided with a bent region or some type of retaining fastener.

By sequencing the individual bars 11 on mountings, which are also made of round rod elements 32′, a generally flat or planar surface extending over the entire oven height is provided to contain the coal front when the coke oven is charged. The resulting array of elongated metal members or bars 11 substantially lie within a plane which is disposed within the interior of the oven inwardly of the door frame 26 and the sealing unit 21. Because of their simple geometry, the individual bars 11, as well as the mountings at the support points or suspensions 32, maintain their shape at high temperatures, since each bar 11 can freely expand in the direction transverse to the oven and each rod element 32′ used for the support points or suspensions 32 can also expand freely in the vertical direction to the oven. Alternatively, other geometries of bar or rod structures with the same physical characteristics could also be employed. For example, the bars or rods could be provided square, rectangular and/or striated shapes.

The preferred one-piece or single unit assembly for supporting the bars 11, as generally illustrated in FIGS. 1*a*, 1*b* and 3, could alternatively be replaced by multi-piece or multiple unit assemblies that are positioned to extend over the height of the inner plate element 10. Such an array of bars 11 can also be made possible by the use of some other type of bar guide (not shown) which is mounted to extend in the vertical direction. For this purpose, the bars 11 are guided to be generally parallel to each other to form a unit which includes a plurality of transverse bars 11 which are distributed over the height of the inner plate element 10.

A leveller door assembly 36 for the preferred coke oven door is shown in FIGS. 1*a*, 1*b* and 4 and includes a round or cylindrical structure. A leveller box 14 is generally tubular and includes a sealing surface 15. A metal cover 16 is pressed against the front of the sealing surface 15 by means of bolts or springs 39 of a force transmission frame 17. General positioning of the cover 16 against the sealing surface 15 is accomplished by hinges 19 and a door closing device 46. When the force by the bolts or springs 39 is introduced to the cover 16 through the force transmission frame 17 and rotation of associated sprocket wheels 20 and the chain drive 18 thereof, anchor points at the hinges 19 and at the closing device 46 are activated. The anchor points of the hinges 19 are at the hinge pins thereof to allow the cover 16 to pivot between an opened and a closed position prior to sealing. The anchor point at the door closing device 46 is operated by means of a handwheel 37 which is installed for axial movement on a spindle which is, in turn, mounted relative to sealing surface 15 by a hinge pin means 38.

As seen in FIGS. 5 through 8, instead of the bars 11, there are a number of alternative bar configurations which can be combined into groups. Each group of bars of the embodiments shown would preferably include a height of about three hundred millimeters. All the bars in the embodiments of FIGS. 5 through 8 have a round cross section although, as mentioned above, any number of different cross sections or profiles could be alternatively employed.

Figure 5:
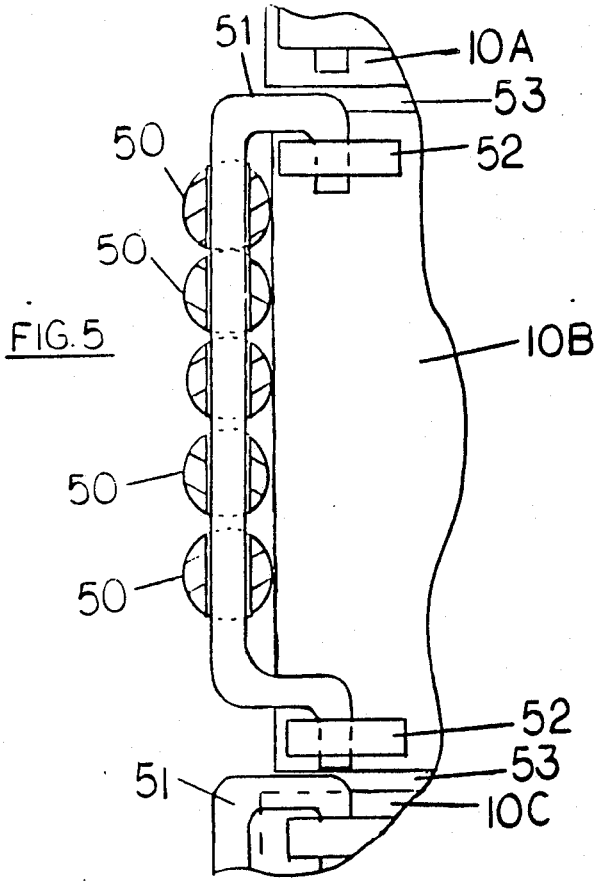
FIGS. 5 through 8 show various possible fasteners for a metal shield consisting of bars or the like including various features of the invention.

In the embodiment illustrated in FIG. 5, each bar 50 has a diameter of about twenty millimeters. For suspension, holes are drilled through the bars 50 so that a wire or rod 51, which is about ten millimeters thick, can be extended through the holes in the individual bars 50 and bent at the ends thereof to retain the assembly of bars 50 thereon. The individual bars 50 are held together by the rods 51. Additionally, the ends of the rod 51 are bent to form hook elements which are capable of being installed in brackets 52 mounted on the inner plate element of the sealing unit. The bars 50 could alternatively be suspended on the rods 51 in the same manner as the preferred bars 11 of FIGS. 1*a*, 1*b* and 3.

Figure 6:
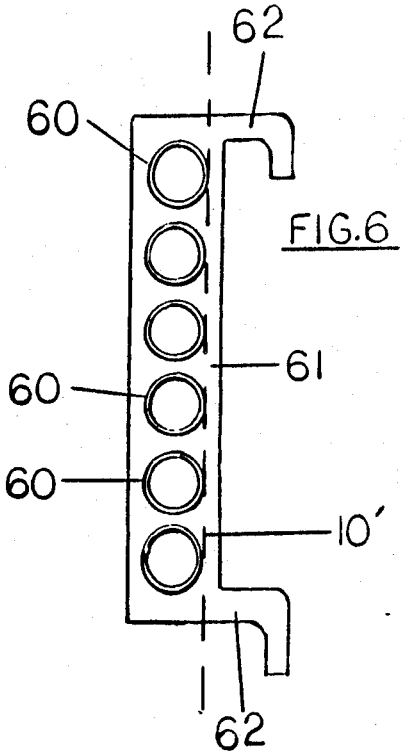

However, as also seen in FIG. 5, the embodiment shown therein includes an additional feature which can be employed in conjunction with the various groups of bars or bands. Specifically, rather than including a unitary construction for the inner plate element as appeared in the embodiments discussed hereinabove, the sealing unit shown in FIG. 5 includes an inner plate element which is basically formed of a plurality of individual inner plate sections 10*a*, 10*b* and 10*c* which have the same general cross section as the inner plate element 10 of FIGS. 1*a* and 1*b*. In other words, the function of the inner plate element of the preferred embodiment is alternatively provided by of a number of inner plate sections which are joined in a vertical array to provide the overall support at the interior side of the sealing unit. As a result, the individual inner plate sections 10*a*, 10*b* and 10*c* each serve as a support for its particular group of bars 50 so that expansion and contraction of the bars 50, the rods 51 and the particular inner plate section 10*a*, 10*b* or 10*c* will generally correspond. It should be noted that there is a slot or space 53 between each of the individual inner plate sections 10*a*, 10*b* and 10*c*. The slots or spaces 53 will tend to allow gas created in the coking operation to pass into and out of the interior of the sealing unit in a similar manner as explained with regard to the interior gas duct discussed hereinabove FIG. 6 shows another alternative embodiment including a plurality or group of bars 60 with a round cross section and a diameter of about fifteen millimeters. The bars 60 are held in place by lateral plates 61. For this purpose, the plates 61 are provided with a plurality of holes into which the bars 60 are inserted in the longitudinal direction. The bars 60, together with the plates 61, form shield elements or groups which are suspended on hooks or catches 62. The dotted line 10' represents the line or area of support by the inner plate element of the sealing unit.

Figure 8:
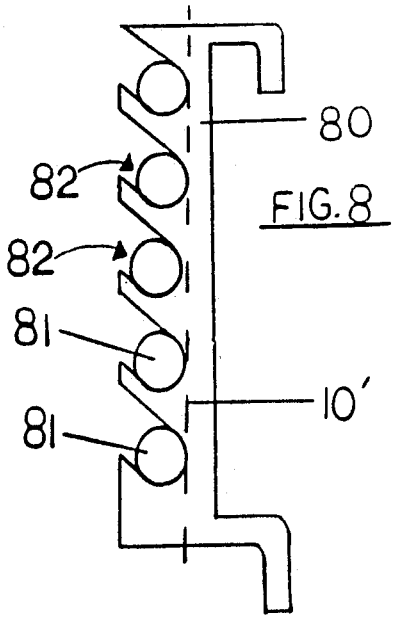

The embodiment illustrated in FIG. 8 differs from the embodiment illustrated in FIG. 6 in that the bars 81 are not inserted in the longitudinal direction. Instead, the bars 81 are generally installed in a direction transverse to their longitudinal direction from the front into lateral plates 80 which have catch-shaped recesses 82 for rëceipt of the bars 81 therein.

Figure 7:
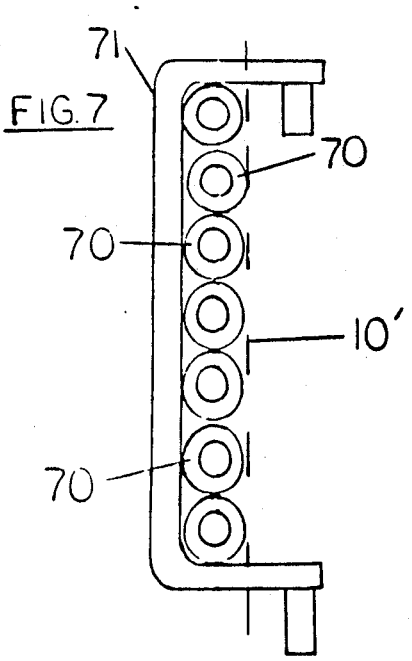

As shown in FIG. 7, a plurality or group of bars 70 are held with bands 71 which are mounted by suitable means to the inner plate element of the sealing unit. Neither the bands 71 nor the inner plate element, as indicated by the dotted line 10', directly support individual bars 70 but combine to define a vertical area in which the plurality of bars 70 are loosely entrapped. It should be noted that each of the bars 70 is hollow or tubular but is still capable of combining with other bars 70 to provide the desired heat shield of the present invention.

A common feature of all of the embodiments shown hereinabove is the use of a plurality of bars which preferably hang loosely underneath one another. When the various embodiments are compared to the one-piece protective shields of the prior art, which are made of heat-resistant metal material, a much more stable shape is achieved even at conventionally high coke oven temperatures. Additionally, the preferred bar assembly is not a welded structure. It should be clear that other cross-sectional shapes of bars, such as those including square, rectangular or other geometric shapes, can be employed. Accordingly, numerous such bars could be selected to include commercially available profiles or cross sections. A one-piece assembly of bars can also be seen to allow a bar guide to be used in the vertical direction to be parallel to and extend over the height of the inner plate element. Since the bars and/or rods can be made significantly thinner while retaining sufficient bending strength, the preferred shield according to the invention is lighter overall than the flat, one-piece plate shields of the prior art. Because of the lightweight construction and easy fabrication, the preferred heat shields are more economical than the designs of the prior art.

Figure 9:
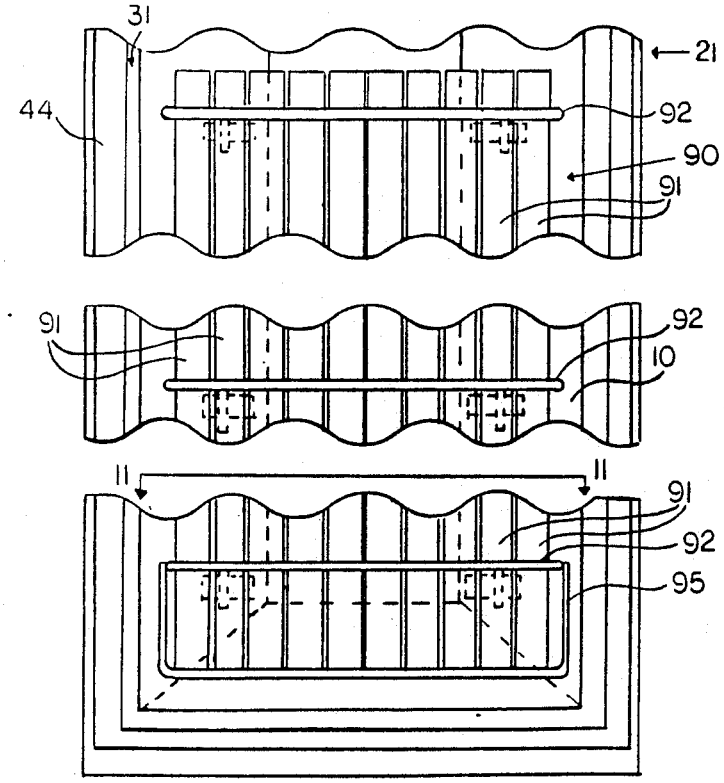
FIG. 9 shows an enlarged fragmentary, elevated front view of an alternative embodiment of the metal shield of the invention.
Figure 10:
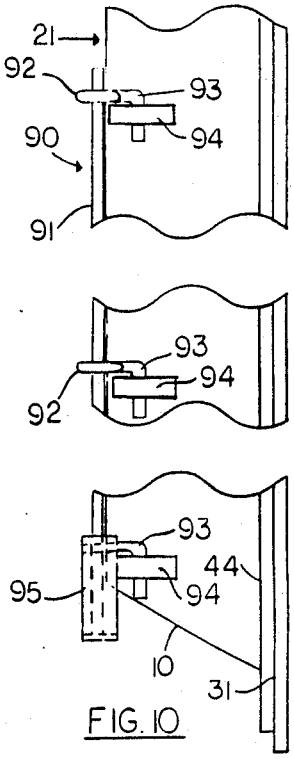
FIG. 10 is an enlarged fragmentary, elevational side view of the embodiment of FIG. 9.
Figure 11:
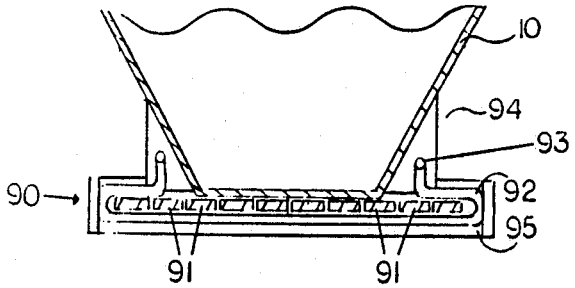
FIG. 11 is a view of the embodiment of FIG. 9 as seen along line 11—11.

As seen in FIGS. 9, 10 and 11, another alternative embodiment includes a heat shield 90 which is secured to the interior side of the sealing unit 21. Specifically, the heat shield 90 includes a plurality of vertically extending metal bands 91 which extend longitudinally of the inner plate element 10. The plurality of bands 91 are retained in position generally against the interior central portion of the inner plate element 10 by at least three transversely extending band retainers 92. Each band retainer 92 is made of some form of rod or bar material to generally encircle the plurality of bands 91. Each end of each band retainer 92 is bent in order to include a hook 93 which is received within a fitting 94 mounted on the inner plate element 10. To maintain each band 91 in a vertical position relative to the inner plate element 10, the lower band retainer 92 includes a U-shaped base member 95 which is welded to the ends of the lower band retainer 92. The U-shaped base member 95 generally extends beneath the plurality of bands 91 so that the lower end of each band 91 rests against and is supported by the U-shaped base member 95.

The heat shield 90, as described above, includes the plurality of bands 91 which are capable of expanding longitudinally and are capable of minimal transverse movement within the band retainers 92. Accordingly, each of the bands 91 will be loosely retained in position relative to the inner plate element 10 during the coking operation. The embodiment shown in FIGS. 9, 10 and 11 is also capable of providing the two side gas ducts in the same manner as the other embodiments described hereinabove.

Figure 12:
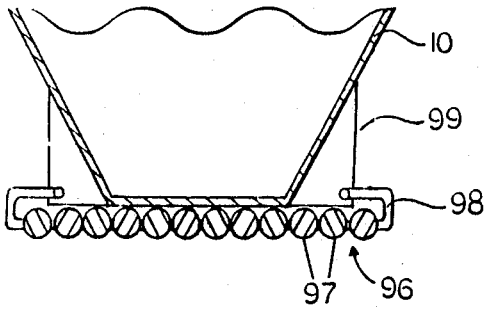
FIG. 12 is a view similar to that of FIG. 11 showing still another alternative embodiment of the invention.

As seen in FIG. 12, still another embodiment is shown in a view similar to that of FIG. 11. Specifically, another heat shield 96 includes a plurality of vertically extending bars 97 which are joined one to the other and generally secured to the interior side of the inner plate element 10 by transversely extending retainers 98. The transversely extending retainer 98 is preferably made of rod material which has a smaller diameter than the bars 97. Each of the bars 97 is provided holes extending therethrough for receipt of the transversely extending retainer 98. The rod material of the retainer 98 is bent to form hooks at the ends thereof for receipt within fittings 99 in a similar manner as the embodiment shown in FIGS. 9, 10 and 11. The heat shield 96 would include at least three or more retainers 98 but would no longer require any element such as the U-shaped base element 95 of the heat shield 90 since the bars 97 will be properly supported vertically by each of the retainers 98 extending through the holes within the bars 97. Again, the heat shield 96 includes the plurality of bars 97 which are capable of longitudinal and transverse movement relative to the inner plate element 10 while still being capable of providing a proper heat shield and the two side gas ducts mentioned hereinabove.

It should be clear from heat shield 90 and heat shield 96 that a configuration of vertically extending, elongated metal members can be employed as the major portion of most of the elongated members are generally supported by the interior central portion of the inner plate element 10.

Figure 13A:
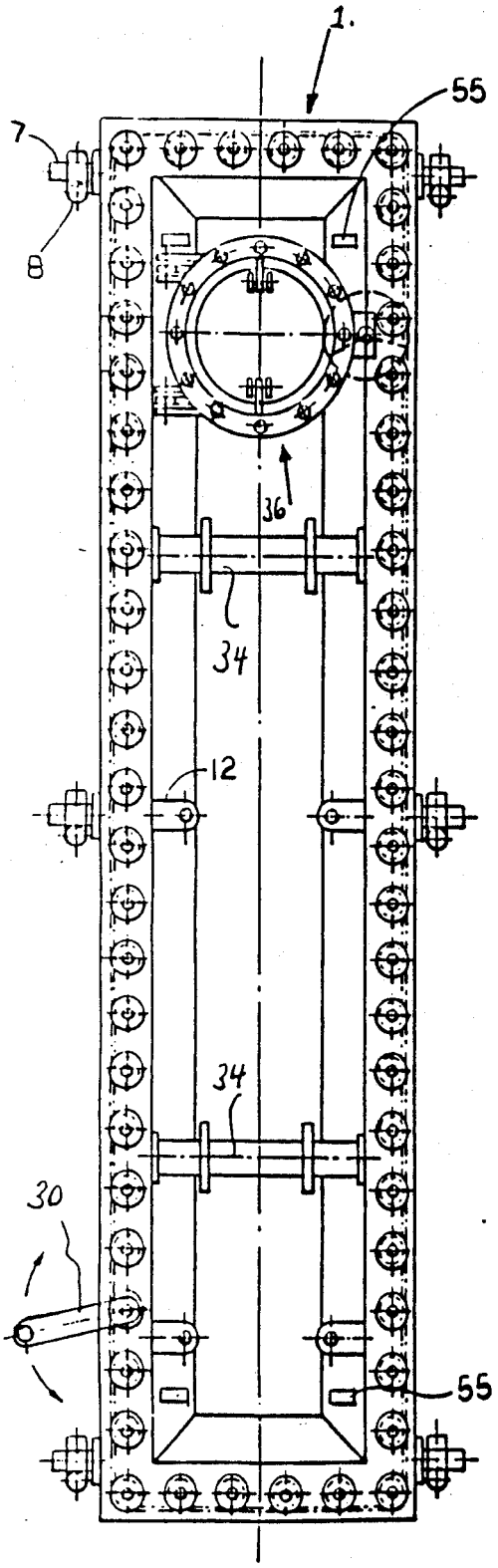
FIGS. 13*a* and 13*b* are views similar to those of FIGS. 1*a* and 1*b* but include additional features of the invention.
Figure 13B:
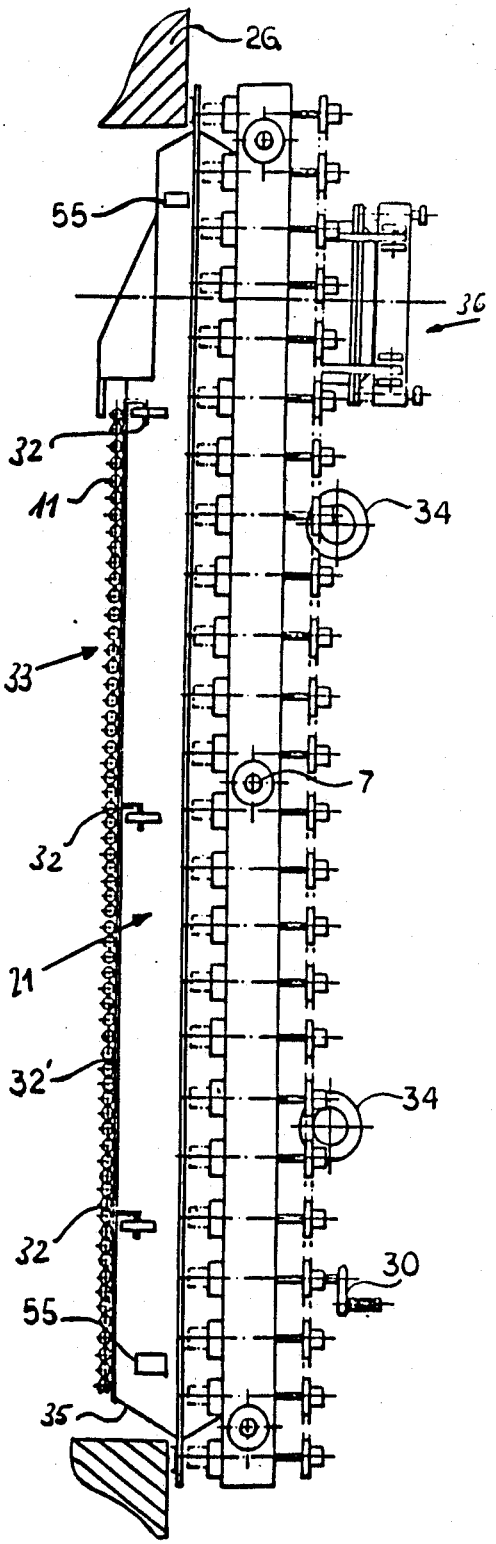

Finally, as best seen in FIGS. 13*a* and 13*b*, the preferred inner plate element 10 may, as mentioned above, be provided openings or slots 55 at the lower region and at the upper region thereof. Although addition slots 55 may be provided in other locations in the intermediate region of the inner plate element 10, it is advantageous to include the slots 55 or some other type of openings at at least the lower and upper regions thereof in order to insure a proper upward flow of the coking gas through the interior gas duct within the hollow interior of the sealing unit 21.

In summing up, although suggestions were made to use steel shields on coke oven doors as long ago as the turn of the century, such metal shields have never gained significant acceptance in actual practice. The reluctance to use such metal shields can, in part, be easily explained by the characteristics of the material available at that time. Steel shields which must come into direct contact with hot coke are exposed to temperatures significantly higher than 1000 degrees C. Steels with the necessary high-temperature strength, such as high-alloy steels, have only recently become available. The alloy ingredients might include various quantities of chromium, aluminum, nickel, silicon, and/or titanium. Approximately eight years ago, the first tests employing these improved steels were begun. These tests were based on the simulation of a ceramic plug by the use of plates of heat-resisting steel. Initially, however, the tests were not successful. Accordingly, the steel structure employed in coke oven door configurations has been primarily limited to use in one shield for the coke oven door. It is not uncommon for such a shield to include individual, overlapping plates. However, it has been found that the plates also experience significant deformation. Therefore, various alternatives have been proposed with the objective being to create a practical partial shield with a long service life.

In this regard, it should be recognized that a preferred shield configuration includes a plurality or array of elongated metal members, such as bars; bands or sheets; and/or grating or grid means. A number of other developments in the coke oven door heat shield art have been primarily directed to one-piece shields which extend over the height of the coke oven door. The present invention takes precisely the opposite direction in terms of a configuration intended to reduce the dimensions of the shield. It had previously been feared that the extreme or added dimensions required for bars, bands and/or grating would result in extreme heat deformation. Such fears have turned out to be groundless. This is primarily due to the fact that the preferred bars, bands and/or grating are supported over as much of their length as possible in order to provide additional structure to reduce deformation. With the other solutions of the prior art which employ other types of shields, there is no such support. The other shields of the prior art tend to be supported at two points or along two lines. Between these points or lines, these shields are exposed to very significant bending stresses.

The preferred support, according to the invention, is provided by a one-piece or multi-piece sealing unit or door box which is located behind the bars, bands or grating when the coke oven door is in the closed position.

The bars according to the invention can be solid or hollow. The cross section of the bars can be square, rectangular or round. Even irregularly-shaped cross sections are conceivable.

The bars are preferably from ten to thirty millimeters thick. Alternatively, bands can be distinguished from the bars by having a significantly reduced thickness of, for example, four to ten millimeters and a greater width of, for example, up to about one hundred millimeters.

The bars or bands can extend transverse to the longitudinal direction of the door or in the longitudinal direction of the door.

For fastening the bars or bands relative to the coke oven door, the invention optionally specifies various types of fasteners, which tend to extend transverse to the longitudinal direction of the bars or bands. For example, such fasteners can be formed of plates or bands which are bent backward on the support or which extend to the other portions or elements of the door. Other suitable fasteners include thinner bars which are engaged with and extend through corresponding openings in the bars forming the metal shield itself. Such fasteners can also be located to extend laterally of the support to include recesses into which the bars and/or bands are inserted in the longitudinal direction or into which the bars and/or bands are inserted from the front, transverse to their longitudinal direction.

Although the individual bars or bands can also be suspended individually or in groups on the support, it is advantageous to combine the bars and/or bands into groups. Preferably, such a group, with bars running transverse to the longitudinal direction of the door, could be, for example, from two hundred to four hundred millimeters high. Optionally, these groups could also correspond with one or more elements which are used to form the sealing unit or door box serving as the support. These elements of the door box which serve as the support would then have the same structural height as the groups of bars or bands. Between the elements of the box which serve as the support, there are preferably provided slots. The slots are intended to allow the entry of raw gas into the door box during the coking process.

In further summing up, one aspect of the invention resides broadly in a door assembly capable of being used in a horizontal coke oven of the type which is capable of receiving an oven charge therein for a coking operation including the production of coking gases; the coke oven having an interior defined by a ceiling, a floor, two side walls and a door opening; the coke oven including a door frame surrounding the opening and including a sealing surface on an exterior portion thereof: the door assembly comprising a heat shield arrangement capable of being disposed within the interior of the coke oven inwardly of the door frame to generally maintain the oven charge away from the door frame; the heat shield arrangement extending generally between the two side walls and between the ceiling and the floor to lie within a plane which extends transversely of the interior of the coke oven when the heat shield arrangement is disposed therein; and the heat shield arrangement including a plurality of generally parallel elongated metal members which combine to form an array of the elongated members lying within the plane.

Also, as mentioned above, numerous coke oven doors of the prior art have employed a massive cast iron body with a ceramic plug installed at the interior side thereof. Because of the ceramic plug, the oven charge was kept at a distance from the coke oven door. Recently, coke oven doors have been used which employ a shield structure instead of a massive, heavy ceramic plug. The shield structure has consisted primarily of metal, but some prior art doors also included ceramic shield structures.

Modern shield structures have, in common, tended to reduce the overall weight of the door bodies. The door bodies can accordingly be provided with an overall, lighter weight. A significant reduction in weight is achieved if, for the door bodies, a sealing element is used which produces sealing, contact pressure by means of a number of contact pressure elements of a force transmission unit. Such a force transmission unit would include a hollow profile frame which is disposed around the circumference of the door against the door frame of the coke oven.

Because of the modern design employing a shield structure, it is not uncommon to include a very large gas duct between the shield structure and the door body The resulting large gas duct is generally regarded with skepticism. There have also been problems involving the fastening of such a shield structure to the door body. The use of some type of spacers is possible, but the spacers do not always provide an overall satisfactory solution.

Accordingly, an improved door body configuration is achieved by means of an inner steel plate element and an outer steel plate element, which are joined together to form the door body. The two plate elements together form a sealing unit which has an encircling peripheral edge portion, which is then brought into contact with the sealing surface of the door frame. By means of this design, a preferred sealing unit includes a one-piece hollow profile which is sealingly disposed within the coke oven door opening.

When taken in conjunction with the shield structure, the preferred sealing unit establishes three primary gas passages. Two side gas passages are respectively generally defined at the sides of the door body by the shield structure, the door frame and the inner steel plate element of the sealing unit. An internal gas passage is defined by the interior of the hollow sealing unit. By providing the two side gas passages and the internal gas passage with free access to one another by means of slots in the inner plate element, the amount of exposed cross section for the raw gas is significantly increased. It is particularly significant that the internal gas passage in the sealing unit of the door body extends outwardly beyond the plane of the sealing surface of the chamber door frame.

Because of the large volume of the combined gas passages, primarily in the initial phase of the coking process, the static pressure established in the gas chamber would be about zero. If the pressure is set sufficiently high in the coke oven gas main, there would be little likelihood of a suction being established on the sealing surfaces of the coke oven door. A typical high pressure setting would be about 8 to 18 mm of water. For each meter of oven height, a pressure of approximately 2 to 3 mm of water is preferred in the coke oven gas main. This pressure is the static pressure. In addition to the static pressure, dynamic pressure must also be taken into consideration. The dynamic pressure is measured by means of a pressure tube in the gas flow through a gas passage, and the static pressure is measured by means of a branch tube in the gas passage. A suction or reduced pressure does not present a problem, if the coke oven doors are sufficiently tight and sealed. It has been found that tight coke oven doors can be subjected to suction, even over the long term, without any adverse effect on the seal. On the other hand, suction can be quite detrimental if leaking occurs around the coke oven doors. Normally, such leaks cannot be eliminated by adjusting the contact pressure elements but only by inspecting the sealing surfaces of the doors and cleaning or repairing them as necessary.

With the sealing unit of the present invention, the complex and expensive door foot required on doors of the prior art is no longer necessary, since the inner plate element simultaneously serves as the door foot because of its configuration.

Because of the shape and thin walls of the preferred sealing unit, the overall profile is subjected to minimal thermal stresses. Nevertheless, because of its excellent flexibility, the preferred sealing unit will be adJacent to deformations of the chamber door frame caused by outside forces.

Because of the preferred form of the sealing unit, the complex and expensive spacers required on shield designs of the prior art are no longer necessary.

The preferred sealing unit structure is fabricated by means of bendable and economical material and is not a welded structure.

The radiation from the outer plate element into the atmosphere is reduced because the shape and location of the inner plate element relative to the outer plate element acts as a shield.

The preferred sealing unit does not require complex and expensive internal insulation. Instead, there is preferably only external insulation 29. The external insulation 29 preferably comprises mineral fibers and is from 5 to 15 mm thick. The external insulation 29 can be attached with adhesive. The mineral fibers used as external insulation can be appropriately protected from rain and the effects of weather. Such protection could alternatively be achieved by means of a metal lining which surrounds the mineral fibers.

Accordingly, the insulation on the outer plate element can be lighter and more economical to provide.

Although the preferred cross section for the sealing unit was discussed hereinabove, it should be recognized that other shapes of inner and outer plate elements are conceivable.

Although the inner and outer plate elements are preferably made of heat-resistant metal material, the outer plate element can even be made of ordinary steel.

The peripheral edges surrounding the web-shaped structure of the sealing unit can be studded with replaceable sealing mechanisms, such as flat gaskets and U-shaped gaskets. Other structural shapes of the sealing mechanisms can also be used to provide, for example, an L-shaped profile or cross section.

Accordingly, one aspect of the invention resides broadly in a coke oven door capable of being used in a horizontal coke oven of the type which is capable of receiving an oven charge therein for a coking operation including the production of coking gases, the coke oven having an interior defined by interior wall arrangement and a door opening which is surrounded by a door frame, the door frame having an external sealing surface, the coke oven door comprising a hollow sealing unit capable of being disposed to extend across the door opening: the sealing unit having peripheral edge portions for overlying, sealing contact with the sealing surface of the door frame; the sealing unit including an inner wall element having at least a central portion thereof disposed within the interior of the coke oven inwardly of the sealing surface of the door frame; internal shield arrangement extending generally transversely across the interior of the coke oven; and the internal shield arrangement being supported at least in a central region thereof by the central portion of the inner wall element.

Another aspect of the invention resides broadly in a coke oven door capable of being used in a horizontal coke oven of the type which is capable of receiving an oven charge therein for a coking operation including the production of coking gases, the coke oven having an interior and a door opening, the door opening being surrounded by a door frame having an external sealing surface thereon, the coke oven door comprising a hollow sealing unit capable of being disposed to extend across the door opening; the sealing unit having peripheral edge portions for overlying, sealing contact with the sealing surface of the door frame; a locking device generally surrounding the sealing unit in alignment with the peripheral edge portions; the locking device being secured to the door frame and capable of applying sealing pressure to the peripheral edge portions to produce the sealing contact between the peripheral edge portions and the sealing surface of the door frame; the sealing unit including an inner wall element and an outer wall element to generally define the hollow interior thereof; the inner wall element having a horizontal cross section which is generally U-shaped; and the inner wall element having a central portion thereof disposed within the interior of the coke oven inwardly of the sealing surface of the door frame to shield the outer wall element from the oven charge.

Generally, as discussed above, on conventional coke oven door bodies, two or more locking elements are distributed over the height of the door body and are rigidly connected thereto. Such locking elements consist of a double-armed pivoting lever which corresponds to lock catches on the chamber door frame. Conventionally, all of the pivoting levers of the locking elements are connected to one another by means of rods and are rotated jointly by the door lifting device, whether locking or unlocking the door. Before locking, the coke oven door is moved by the door lifting device against the door frame in a manner to produce a desired door closing pressure. The locking elements are used to secure the door in this desired position.

With such an arrangement, it has been shown that, because of variations in the forces applied to the door body, consideration had to be given to the physical characteristics of the door body itself. The force was not applied evenly over the door body and was therefore not transmitted evenly to the sealing mechanism or the chamber door frame. As a result, door leakage was not uncommon. In the past, attempts have been made to seal or plug up the leaks with asbestos cords and, later, with ceramic cords. So-called hammered strips or adjustable sealing strips have also been used. Bolts or screws were used as the adjustment devices. Apart from the general objection to turning screws with blows from a hammer, it was also considered inappropriate to require the service personnel to climb up and down to remove leaks on coke oven doors which are four to eight meters high.

The present invention eliminates these disadvantages by the use of a locking device for a coke oven door which does not employ the features of the conventional locking elements, but, instead, relies on the activation of contact pressure elements. The above-mentioned conventional locking elements can therefore be eliminated. Efforts to eliminate conventional locking elements have not been successful in the past, and repeated attempts have been made to improve the locking elements themselves. For example, prior art configurations include an older design in the form of so-called spindle and bubble locks and a newer design in the form of spring locks.

The preferred locking device which employs a plurality of contact pressure elements is preferably used on doors of lightweight construction which include a peripheral sealing element which makes sealing contact with the chamber door frame. The locking device preferably includes a force transmission unit having a hollow profile frame, which is equipped with a number of automatically rotatable contact pressure elements.

All or some of the rotatable contact pressure elements installed in the hollow profile frame are moved by means of sprocket wheels or a chain or several chains from one turning point or from several turning points. A torque machine (driven hydraulically, electrically or pneumatically) installed on the oven operating machine is engaged at the turning point or turning points and provides the chain with proper tension for locking and unlocking the lightweight door. Pneumatic screw type machines which rotate at a relatively slow speed are particularly suitable.

The force created by the locking device is transmitted to the door sealing element by a number of screws or bolts or springs associated with the contact pressure elements to guarantee the seal between the sealing element and the chamber door frame.

Distributed on the external sides of the hollow profile frames of the preferred locking device are a number of bolts, including at least two at the top of the door and at least two at the bottom of the door. When the door is placed in position against the door frame, these bolts fit into adjustable latches, which are connected with the chamber frame, to form a positive connection or anchor when the door is locked.

For protection against heat, dust and moisture, the sprocket wheels and the chain have a removable cover.

As a result of the invention, the uneven sealing force of the prior art locking elements is avoided, because the levels of the forces introduced at each contact point around the sealing element are identical. Additionally, the hollow profile frame is capable of compensating for each bend in the chamber door frame because of its high flexibility. Further, the hollow profile frame employed to hold the automatically rotatable contact pressure elements can be selected from commercially available profiles, such as square hollow profiles, U-shaped profiles, L-shaped profiles, T-shaped profiles, double-T profiles, and tubular profiles. It should be clear that the preferred type of locking device can also be used on conventional doors. Still further, all of the individual parts for the fabrication of the preferred rotatable contact pressure elements can be selected so that they consist of commercially available parts. Also, the rotatable contact pressure elements installed in the hollow profile frame are protected against heat, moisture and dust and include a hood covering for the sprocket wheels or chain drive. Finally, in addition to the preferred chain drive, other drive mechanisms could also be used.

Accordingly, one aspect of the invention resides broadly in a metal shield for an oven, the oven having an interior, a door opening which is surrounded by a door frame, and a door for extending across the door opening: the door being for making sealing contact with the door frame, the metal shield comprising a plurality of generally parallel elongated metal members which combine to form an array of the elongated metal members substantially lying within a plane; the array of the elongated metal members being disposed within the interior of the oven inwardly of the door frame and inwardly of the door when the door is in the sealing contact with the door frame: and the array of the elongated metal members extending generally transversely to the interior of the oven with the plane being generally parallel to the door frame.

The invention as described hereinabove in the context of a preferred embodiment is not to be taken as limited to all of the provided details thereof, since modifications and variations thereof may be made without departing from the spirit and scope of the invention.

What is claimed is:

1. An oven door assembly comprising a peripheral door frame, a peripheral sealing means secured to said door frame for sealing an oven door opening and a metal heat shield, said metal heat shield comprising:

a multiplicity of elongated metal members having elongated axes;

means for retaining said elongated metal members in at least one array in which said elongated axes are disposed generally parallel to each other within a plane, said retaining means extending across said elongated metal members at spaced points along the axes of said members and maintaining a space between adjacent members of said elongated metal members in the array; and means for supporting said array of elongated metal members on said sealing means so as to extend parallel to the door frame and sealing means and thereby shield the same from heat generated in an oven.

2. The door assembly of claim 1, wherein the axes of said elongated metal members in said array extend horizontally.

3. The door assembly of claim 1, wherein the axes of said elongated metal members in said array extend vertically.

4. The door assembly of claim 1, wherein said peripheral sealing means includes a central portion extending across and inwardly of the door frame, and said supporting means secures said array to said central portion.

5. The door assembly of claim 1, wherein said retaining means comprises mounting retainers for loosely mounting said elongated metal members in said array such that the members are relatively movable along said elongated axes.

6. The door assembly of claim 1, wherein said retaining means comprises mounting retainers for loosely mounting said elongated metal members in said array such that adjacent members are relatively movable with respect to each other.

7. The door assembly of claim 1, wherein said elongated metal members have opposite ends, and said retaining means extends across said elongated metal members at each of said opposite ends.

8. The door assembly of claim 7, wherein each of said elongated metal members has a hole extending transversely therethrough at said opposite ends, and said retaining means comprises a rod extending through said holes at each of the opposite ends.

9. The door assembly of claim 7, wherein said retaining means includes members at least partially surrounding each of said elongated metal members at the opposite ends.

10. The door assembly of claim 1, wherein said elongated metal members are rectangular bars.

11. The door assembly of claim 10, wherein said bars are hollow.

12. The door assembly of claim 1, wherein said elongated metal members are circular bars having a diameter of about 10–30 mm.

13. The door assembly of claim 1, wherein said elongated metal members are bands having a rectangular cross-section of about 4–10 mm thick and up to about 100 mm wide.

14. The door assembly of claim 1, wherein said at least one array comprises at least two arrays of said elongated metal members sequentially disposed and supported on said sealing means so as to extend parallel to the door frame and sealing means.

15. The door assembly of claim 14, wherein the axes of said elongated metal members in each of said arrays extend horizontally and each of said arrays has a vertical height of about 200–400 mm.

16. The door assembly of claim 14, wherein said peripheral sealing means includes a central portion extending across the door frame, said central portion comprising an outer plate means and an inner plate means defining a hollow interior, and said supporting means secures said arrays of elongated metal members to said inner plate means.

17. The door assembly of claim 16, wherein said inner plate means comprises at least two sequential inner plate sections having a space therebetween defining a gas inlet into the hollow interior for removing generated oven gases, and each of said inner plate sections includes said supporting means for supporting a respective one of said arrays.

* * * * *

UNITED STATES PATENT AND TRADEMARK OFFICE

CERTIFICATE OF CORRECTION

PATENT NO. : 4,927,501

DATED : May 22, 1990

INVENTOR(S) : Wolfgang BECKER

It is certified that error appears in the above-identified patent and that said Letters Patent is hereby corrected as shown below:

Column 16, line 8, insert the following paragraph:

--The elongated metal members form an array. The elongated metal members of the array lie within a plane. The elongated axis of the elongated metal members are parallel to one another and are separated from one another. The array of elongated members is disposed adjacent to the door in the oven. The elongated metal members are disposed next to one another in a side-by-side manner. The elongated members have immediate adjacent portions. The immediate adjacent portions are adjacent to one another. A substantial portion of the intermediate adjacent portions have areas which are not attached to one another. The plane of the heat shield is substantially parallel to a plane across a door frame.--

Signed and Sealed this

Second Day of July, 1991

*Attest:*

*Attesting Officer*

HARRY F. MANBECK, JR.

*Commissioner of Patents and Trademarks*